US011313545B1

(12) United States Patent
Jiang et al.

(10) Patent No.: US 11,313,545 B1
(45) Date of Patent: Apr. 26, 2022

(54) DIRECT-TYPE PANEL LAMP WITH ADJUSTABLE LIGHT EMITTING FUNCTION

(71) Applicant: CH LIGHTING TECHNOLOGY CO., LTD., Shaoxing (CN)

(72) Inventors: Jiangfeng Jiang, Shaoxing (CN); Jizhong Pu, Shaoxing (CN)

(73) Assignee: CH LIGHTING TECHNOLOGY CO., LTD., Shaoxing (CN)

( * ) Notice: Subject to any disclaimer, the term of this patent is extended or adjusted under 35 U.S.C. 154(b) by 0 days.

(21) Appl. No.: 17/170,935

(22) Filed: Feb. 9, 2021

(30) Foreign Application Priority Data

Nov. 27, 2020 (CN) ..... 202022808687.5

(51) Int. Cl.

| | |
|---|---|
| ***F21V 23/00*** | (2015.01) |
| ***F21V 3/00*** | (2015.01) |
| ***F21Y 105/10*** | (2016.01) |
| ***F21Y 113/10*** | (2016.01) |
| ***F21Y 115/10*** | (2016.01) |

(52) U.S. Cl.
CPC ..... *F21V 23/003* (2013.01); *F21V 3/00* (2013.01); *F21Y 2105/10* (2016.08); *F21Y 2113/10* (2016.08); *F21Y 2115/10* (2016.08)

(58) Field of Classification Search
CPC ..... F21V 23/003; F21V 23/002; F21V 15/01; F21V 15/012; F21V 15/013; F21V 7/00; F21V 7/0066; F21Y 2105/10; F21Y 2105/16; F21Y 2105/00; F21Y 2105/12; F21Y 2113/10; F21Y 2113/13; F21Y 2103/10; F21Y 2105/14; F21S 10/023
See application file for complete search history.

(56) References Cited

U.S. PATENT DOCUMENTS

2008/0088570 A1* 4/2008 Chang ..... G09G 3/3413 345/102
2008/0143916 A1* 6/2008 Fujino ..... G02F 1/133609 349/58
2008/0252197 A1* 10/2008 Li ..... H05B 45/46 313/502

(Continued)

FOREIGN PATENT DOCUMENTS

CN 111765422 A * 10/2020
CN 112361290 A * 2/2021

(Continued)

*Primary Examiner* — Erin Kryukova

(57) ABSTRACT

The application discloses a direct-type panel lamp with adjustable light emitting function, which comprises a frame, a diffusion plate, a back plate and at least one light bar; a central area of the back plate is arched to form a chamber for accommodating the light bar; the diffusion plate has a light-transmitting function, which is disposed opposite to the back plate to close the chamber; the frame is formed by connecting a plurality of frame bars, with each frame bar being connected to corresponding edges of the diffusion plate and the back plate; for the same light bar, the LED beads comprise a plurality of first LED beads and a plurality of second LED beads, and wherein the first LED beads and the second LED beads are alternately arranged, and the brightness or color temperature of the first and second LED beads are different.

10 Claims, 8 Drawing Sheets

(56) References Cited

U.S. PATENT DOCUMENTS

| | | | | |
|---|---|---|---|---|
| 2010/0208452 | A1* | 8/2010 | Park | G02F 1/133608 362/97.1 |
| 2014/0160749 | A1* | 6/2014 | Lee | G02F 1/133611 362/235 |
| 2016/0252231 | A1* | 9/2016 | Fujikawa | F21V 19/005 362/235 |
| 2017/0122503 | A1* | 5/2017 | Ozaki | F21K 9/60 |
| 2019/0154234 | A1* | 5/2019 | Oh | F21V 7/0066 |
| 2019/0350061 | A1* | 11/2019 | Rashidi Doust | H05B 47/10 |

FOREIGN PATENT DOCUMENTS

| | | | | |
|---|---|---|---|---|
| EP | 3620712 | A1 * | 3/2020 | F21S 10/023 |
| KR | 20160134963 | A * | 11/2016 | |
| WO | WO-2016208958 | A1 * | 12/2016 | F21V 19/0015 |

* cited by examiner

DIRECT-TYPE PANEL LAMP WITH ADJUSTABLE LIGHT EMITTING FUNCTION

TECHNICAL FIELD

The present application relates to the field of panel lamps, in particular to direct-type panel lamps with adjustable light emitting function.

BACKGROUND

LED panel lamp has the advantages of good uniformity of illumination, soft and comfortable light, environmental protection material, and low power consumption, which is currently a popular indoor lighting fixture.

In general, the panel lamp includes a frame, a back plate, a diffusion plate, a driving power supply, and a plurality of light bars, wherein the back plate is installed on the back side of the frame, and the diffusion plate is installed on the anterior of the frame. The back plate has a chamber that includes a flat bottom wall and an inclined side wall, wherein the light bars are fixed on the bottom wall, and the driving power supply is installed on the side of the panel lamp facing away from the light-emitting side. The light from the light bars passes through the diffusion plate with high light transmittance to become a uniform planar light, and the driving power supply functions to drive the light bars.

In order to enable the light emitting from the panel lamp to be adjustable, the light bars are selected with different color or brightness. In this case, the number of light bars is additionally increased, which may cause the light bars to occupy a large internal space of the panel lamp.

SUMMARY

In order to solve the above problem, the application provide a direct-type panel lamp with adjustable light emitting function, which can reduce the internal space of the panel lamp occupied by the light bars.

The present application provides a direct-type panel lamp with adjustable light emitting function, comprising:

at least one light bar comprising a substrate, and LED beads fixed on the substrate, wherein, for the same light bar, the LED beads comprise a plurality of first LED beads and a plurality of second LED beads, and wherein the first LED beads and the second LED beads are alternately arranged, and the brightness or color temperature of the first and second LED beads are different; and a back plate and a diffusion plate arranged opposite to each other and together form a chamber, and the light bars are arranged in the chamber and fixed to the back plate.

Several alternatives are also provided below, but are not to be taken as additional limitations to the subject matter described above, merely as a further addition or preference, without technical or logical contradiction. The alternatives may be combined with the above subject matter, individually or in combination.

Optionally, all of the first LED beads are connected to a first circuit and receive a driving signal through the first circuit, and all of the second LED beads are connected to a second circuit and receive a driving signal through the second circuit.

Optionally, the direct-type panel lamp is provided with a driving module which sends a driving signal to the first circuit and the second circuit, respectively.

Optionally, adjacent light bars are electrically connected by a flexible strip; and the light bars extend longitudinally and are spaced apart from each other, and the flexible strip extends transversely.

Optionally, two flexible strips are provided, and wherein one flexible strip is connected to the driving module through the first circuit, and the other flexible strip is electrically connected to the driving module through the second circuit.

Optionally, the first LED beads and the second LED beads are alternately arranged one after another or in groups, and in the case where the first LED beads and the second LED beads are alternately arranged in groups, the number of the LED beads of the group are the same or different, and the number of the LED beads in at least one group is greater than one.

Optionally, in the case where the first LED beads and the second LED beads are alternately arranged in groups, the number of the LED beads of the groups are the same, and the number of the LED beads of each group ranges from 2 to 5.

Optionally, the LED beads on the light bars are aligned with each other, and wherein, the first LED beads of one of two adjacent light bars are aligned with the first LED beads of the other of two adjacent light bars one by one; or the first LED beads of one of two adjacent light bars are aligned with the second LED beads of the other of two adjacent light bars one by one.

Optionally, in the same light bar, adjacent first LED bead and second LED bead are defined as one group of beads, and a spacing between the first LED bead and the second LED bead in the same group of beads is L1, and a spacing between two adjacent groups of beads is L2, and L2: L1=2~8.

Optionally, adjacent light bars are electrically connected by a flexible strip, and the flexible strip is located between two adjacent groups of beads, and at most one group of beads is arranged between two flexible strips.

Optionally, in the same light bar, an interval between two adjacent first LED beads is equal to an interval between two adjacent second LED beads; and for any first LED bead and two second LED beads adjacent to the first LED bead, a distance from the first LED bead to one of the two second LED beads is smaller than the distance from the first LED bead to the other of the two second LED beads.

Optionally, in the same light bar, for any first LED bead and two second LED beads adjacent to the first LED bead, the distance from the first LED bead to one of the two second LED beads is L3, the distance from the first LED bead to the other of the two second LED beads is L4, and L4: L3=1.5~6 is satisfied.

Optionally, a central area of the back plate is arched to form a chamber with a desired space, and the chamber comprises a flat bottom wall to which the light bars are fixed, and a side wall at a periphery of the bottom wall.

Optionally, the diffusion plate is made of a light-transmitting material and closes the chamber with the back plate.

Optionally, a frame is arranged around the back plate and the diffusion plate, and the frame is formed by connecting a plurality of frame bars, each frame bar is connected with corresponding edges of the diffusion plate and the back plate.

Optionally, the direct-type panel lamp further comprises a reflective sheet, and the reflective sheet comprises a central region and a fold edge extending along a peripheral side of the central region, and wherein the fold edge defines notches at corners thereof, the central region of the reflective sheet is in contact with the bottom wall, the fold edge is in contact with the side wall, and two opposite sides of the notch are engaged with each other to form a box-like structure.

Optionally, the LED beads are respectively covered with lenses.

Optionally, the substrate is located between the reflective sheet and the back plate, and the reflective sheet is provided with avoiding holes for avoiding the LED beads and the lenses.

Optionally, the reflective sheet is further provided with a plurality of access holes; and adjacent light bars are electrically connected by a flexible strip, and junctions of the light bars and the flexible strips correspond to the respective access holes one by one.

The present application also provides a direct-type panel lamp with adjustable light emitting function, comprising:

at least one light bar comprising a substrate, LED beads fixed on the substrate and lenses covering the LED beads, wherein for the same light bar, the LED beads comprise a plurality of first LED beads and a plurality of second LED beads, and wherein the first LED beads and the second LED beads are alternately arranged, and the brightness or color temperature of the first and second LED beads are different;

a back plate, a central area of which is arched to form a chamber for accommodating the light bar, and the chamber comprises a flat bottom wall and an inclined side wall, and the light bars are fixed on the bottom wall;

a diffusion plate having a light-transmitting function, which is disposed opposite to the back plate to close the chamber; and a frame formed by connecting a plurality of frame bars, with each frame bar being connected to corresponding edges of the diffusion plate and the back plate.

The first LED beads and the second LED beads of the present direct-type panel lamp are arrange alternately, so that the LED beads of the light bars can be arranged more compactly, so as to prevent the light bars from occupying a large internal space of the direct-style panel lamp.

Figure 1:
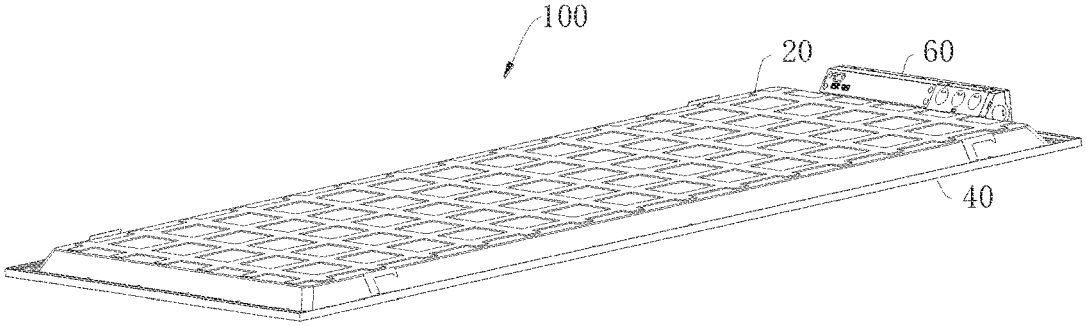
FIG. 1 is a schematic structural view of a direct-type panel lamp according to an embodiment of the present application.

In the figure, reference numerals are illustrate as follows:

100, a direct-type panel lamp; 101, a driving module;

10, light bar; 11, substrate; 111, metal layer; 112, insulating layer; 113, circuit layer; 114, second opening; 115, solder pad; 12, led bead; 13, lens; 131, protruding leg; 14, flexible strip; 141, first opening; 142, insulating layer; 143, circuit layer; 144, solder resist layer; 15, first LED bead; 16, second LED bead;

20, back plate; 211, protrusion; 22, edge area; 221, central area; 23, chamber; 231, bottom wall; 232, side wall; 24, rib; 25, slope area; 30, diffusion plate; 40, frame; 41, frame bar; 42, first mounting surface; 43, second mounting surface; 44, horizontal portion; 45, vertical portion; 46, thickened portion; 47, upright portion; 471, screw groove;

50, reflective sheet; 51, central region; 52, fold edge; 53, notch; 54, avoiding hole; 55, access hole;

60, driving box; 61, box body; 611, wire leading cavity; 612, wire leading hole; 62, top cover; 63, cover plate; 631, single hole; 632, single cover; 633, cover portion; 634, fixed portion; 64, first side; 641, second side; 642, third side; 643, fourth side; 644, fifth side; 65, tab; 66, insulating box.

DESCRIPTION OF THE EMBODIMENTS

The technical solutions according to the embodiments of the present disclosure will be described apparently and completely below with reference to the drawings according to the embodiments of the present disclosure. Obviously, the described embodiments are illustrated as a part of the embodiments of the present disclosure, but not exhaustive. Based on the embodiments of the present disclosure, all other embodiments obtained by a person skilled in the art without inventive efforts fall within the protection scope of the present disclosure.

It should be noted that, when a component is "connected" with another component, it may be directly connected to another component or may be indirectly connected to another component through a further component. Similarly, when a component is "provided" on another component, it may be directly provided on another component or may be provided on another component through a further component.

Unless otherwise defined, all technical and scientific terms used herein have the same meaning as commonly understood by a person skilled in the art. The terms in the description of the present disclosure are used to describe specific embodiments, and not to limit the present disclosure. The terms "and/or" used herein are intended to include one or more of the correspondingly listed options.

In general, a direct-type panel lamp includes a lamp housing. At least one side of the lamp housing is configured as a light-transmitting side. Light emitting elements are mounted in the lamp housing, and emit light towards the light-transmitting side. The so called direct-type panel lamp refers to a panel lamp the light-transmitting side of which is located at the bottom of the lamp housing when in use, and the light emitting elements of which directly emit light towards the light-transmitting side (i.e. downwardly). In the case where the light-emitting elements are configures as LED, the corresponding driving module is configured according to the light emitting requirement of the light-emitting elements. The driving module may be separately provided so that any spatial relationship between the driving module and the lamp housing is possible, provided that the driving module and the lamp housing are electrically connected when in use. Alternatively, the driving module may be fixed and installed to the lamp housing in an integrated manner.

As shown in FIG. 1 to FIG. 6, in one embodiment of the present application, a direct-type panel lamp with adjustable light emitting function is provided, including at least one light bar 10, a back plate 20 and a diffusion plate 30.

The light bar includes a substrate 11, and LED beads 12 fixed on the substrate 11. For the same light bar 10, the LED beads 12 includes a plurality of first LED beads 15 and a plurality of second LED beads 16, wherein the first LED beads 15 and the second LED beads 16 are alternately arranged, and the brightness and/or color temperature of the first and second LED beads 15 and 16 are different.

The back plate 20 and the diffusion plate 30 are opposite to each other and together form a chamber 23, and the light bars are located in the chamber 23 and are fixed to the back plate 20.

In the present embodiment, the back plate 20 and the diffuse plate 30 together form the lamp housing. The lamp housing itself may take conventional structures. Alternatively, in some embodiments below, an improved lamp housing is also provided. The back plate 20 and the diffusion plate 30 may be fixed directly, or indirectly through other components such as a frame.

As shown in FIG. 1 to FIG. 6, a direct-type panel lamp 100 according to an embodiment of the present application includes a frame 40, a back plate 20, a diffusion plate 30, and at least one light bar 10. The central area 221 of the back plate 20 is arched to form a chamber 23 for receiving the light bars 10. The chamber 23 includes a flat bottom wall 231 and an inclined side wall 232, and the light bars 10 are fixed on the bottom wall 231.

The diffusion plate 30 is disposed opposite to the back plate 20 to close the chamber 23. The frame 40 is formed by joining a plurality of (usually four) frame bars 41 end-to-end, each of which is connected to corresponding edges of the diffusion plate 30 and the back plate 20.

The light bar 10 includes a substrate 11, LED beads 12 fixed on the substrate 11 and lenses 13 covering the LED beads 12. The light bars 10 are fixed on the bottom wall 231. The diffusion plate 30 on the light-transmitting side has a light transmitting function (for example, by using light transmitting material). The light emitted from the LED beads 12 sequentially passes through the lenses 13 and the diffusion plate 30 to be diffused, so that a plurality of LED point light sources become a uniform planar light source.

In the prior art, in order to enable the light emitting from the direct-type panel lamp 100 to be adjustable, the light bars 10 are selected with different color or brightness. In this case, the number of the light bars 10 is additionally increased, which may cause the light bars 10 to occupy a large internal space of the direct-type panel lamp 100.

Figure 2:
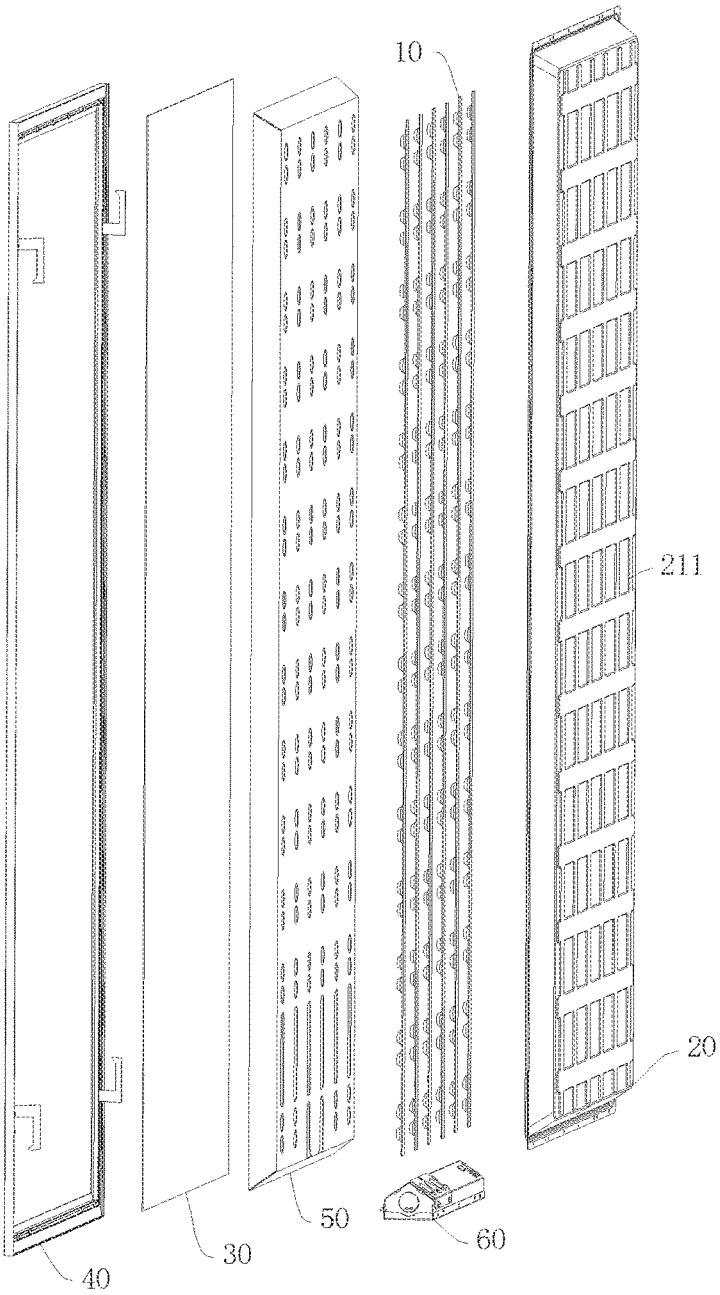
FIG. 2 is an exposed schematic structural view of the direct-type panel lamp in FIG. 1.
Figure 4:
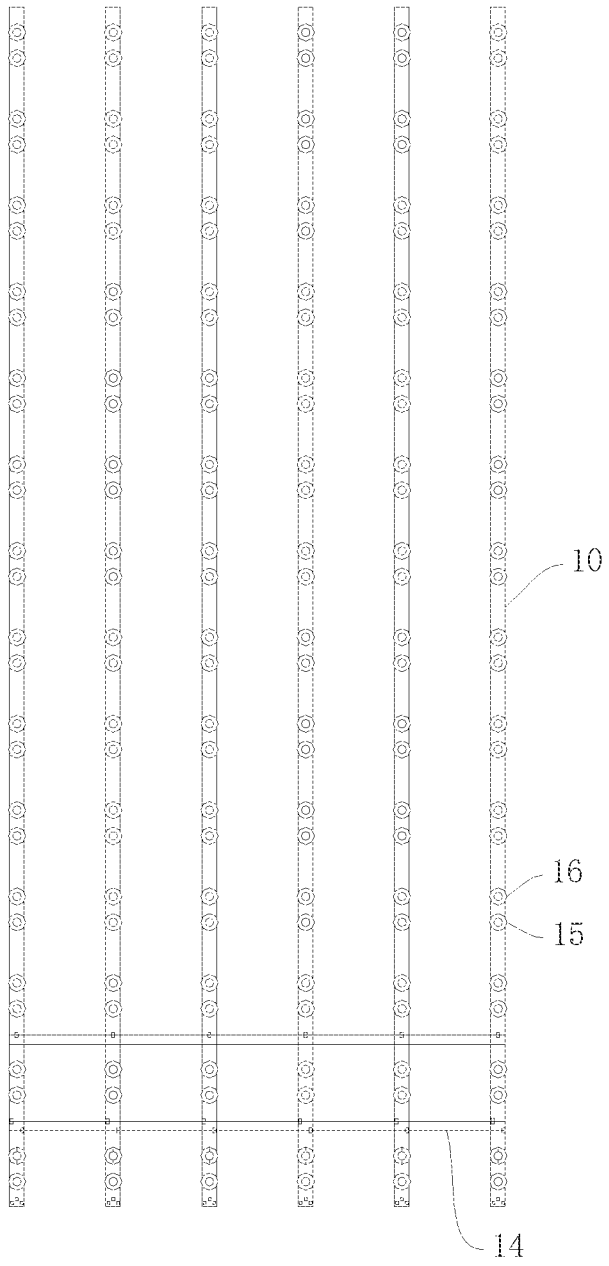
FIG. 4 is a schematic structural view of light bars shown in FIG. 2.

In order to solve this technical problem and enable the light from the direct-type panel lamp 100 to be adjustable, referring to one of the embodiments, as shown in FIG. 2 and FIG. 4, for the same light bar 10, the LED beads 12 includes a plurality of first LED beads 15 and a plurality of second LED beads 16, wherein the first LED beads 15 and the second LED beads 16 are alternately arranged and have different brightness or color temperature.

The first LED beads 15 and the second LED beads 16 are alternately arranged one after another or in groups, for example:

In the case where the first LED beads 15 and the second LED beads 16 are alternately arranged one after another, along the length of the light bar 10, one first LED bead, one second LED bead, one first LED bead, and one second LED bead . . . and the like may be arranged in sequence.

In the case where the first LED beads 15 and the second LED beads 16 are alternately arranged in groups, along the length of the light bar 10, a group of first LED beads, a group of second LED beads, a group of first LED beads, and a group of second LED beads . . . and the like may be arranged in sequence. The numbers of the LED beads of the groups may the same or different, while the number of the LED beads in one group is at least greater than 1. For example, in the case where each group includes two LED beads and the groups are alternately arranged, along the length of the light bar 10, two first LED beads, two second LED beads, two first LED beads, and two second LED beads . . . and the like may be arranged in sequence.

In a preferred embodiment, the numbers of LED beads of the groups are the same, and the number ranges from 2 to 5.

Regarding the brightness or color temperature, for example, the first LED beads 15 may be brighter, and the second LED beads 16 may be darker; the first LED beads 15 may emit white light, and the second LED beads 16 may emit yellow light.

The alternative arrangement between the first LED beads 15 and the second LED beads 16 results that the LED beads 12 of the light bar 10 can be arranged more compactly, so as to prevent the light bars 10 from occupying a large internal space of the direct-type panel lamp 100.

Figure 3:
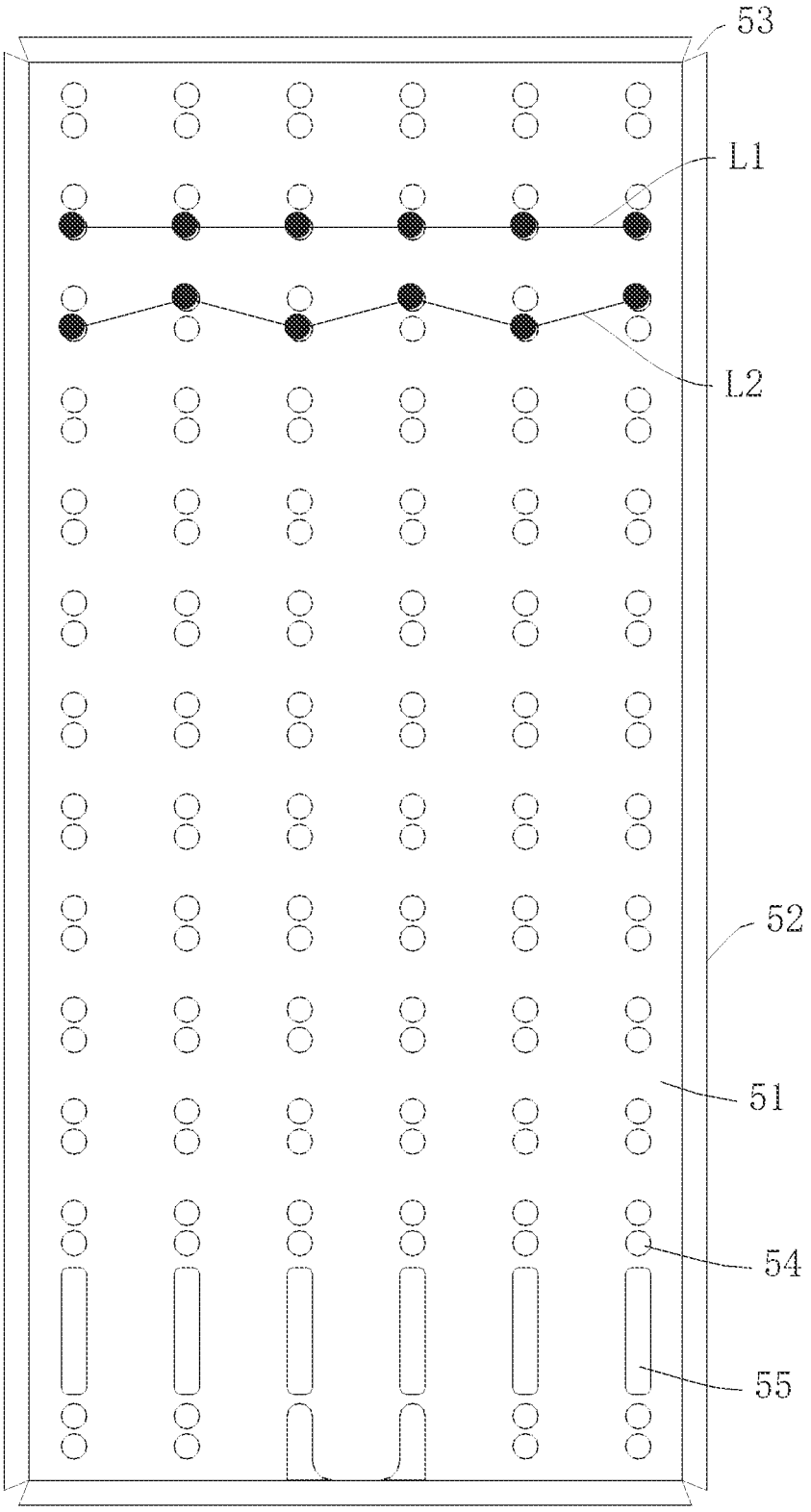
FIG. 3 is a schematic structural view of a reflective sheet in a flattened state shown in FIG. 2.

In some embodiment, as shown in FIGS. 2 and 3, a reflective sheet 50 include a central region 51 and a fold edge 52 extending along the peripheral side of the central region 51.

The fold edge 52 defines notches 53 at the corners thereof. The central region 51 of the reflective sheet 50 is in contact with the bottom wall 231, the fold edge 52 is in contact with the side wall 232, and the two opposite sides of the notch 53 are engaged with each other to form a box-like structure. The notches 53 can prevent the fold edge 52 from wrinkling or folding at the corners of the side wall 232, so as to allow the installed reflective sheet 50 to be smooth and thus avoid the occurrence of light spots. The central region 51 and the fold edge 52 of the reflective sheet 50 are both fixed to the back plate 20 by gluing.

In one embodiment, the central region 51 of the reflective sheet 50 is rectangular, the number of the fold edges 52 is four, and the fold edges 52 are respectively arranged on the corresponding sides of the center region 51. A notch is defined between each two adjacent fold edges 52. Each fold edge 52 extends along the corresponding side of the central region 51 with equal width. In the flatted configuration of the reflective sheet 50, the center line of the notches 53 coincides with the corresponding diagonal of the central region 51.

In one embodiment, the central region 51 covers the bottom wall 231, and the fold edges 52 cover the respective side walls 232, and the two adjacent fold edges 52 do not overlap with each other. The width of the fold edge 52 is equal to or slightly smaller than that of the side wall 232, so that the fold edge 52 can cover the corresponding side wall 232 as much as possible, and at the same time, wrinkles of the fold edge 52, resulting in unsmoothness of the reflective sheet 50, can be avoided.

Figure 5:
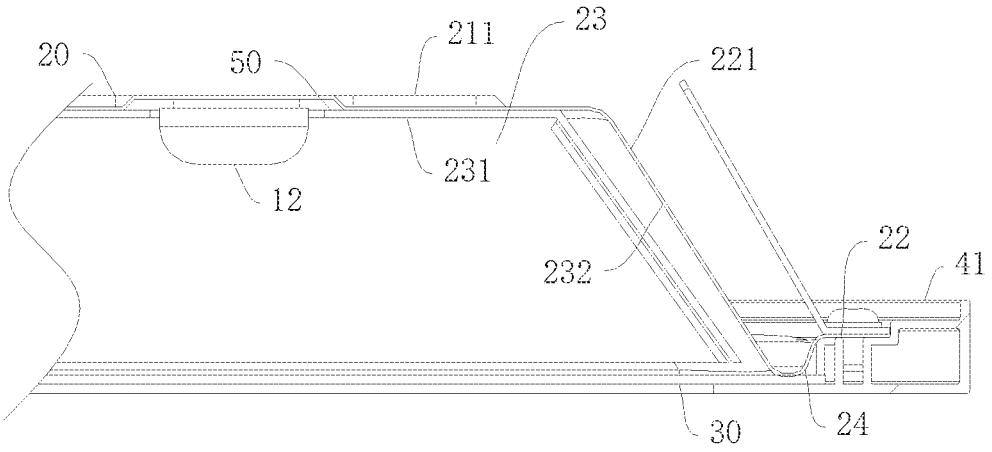
FIG. 5 is a schematic structural view of FIG. 1 with one frame bar not shown.

Regarding the location of the reflective sheet 50, as shown in FIG. 2 and FIG. 5, in one embodiment, the substrate 11 is located between the reflective sheet 50 and the back plate 20, and the reflective sheet 50 defines avoiding holes 54 configured to avoid the interference with the LED beads 12 and the lenses 13. The reflective sheet 50 is capable of shielding the substrate 11 of the light bar 10 so as to avoid the occurrence of the shadow of the substrate 11 which affects the light from the direct-type panel lamp 100. In other embodiment, alternatively, the substrate 11 may be additionally processed such as by coating the substrate 11 with white reflective material, but the procedure for the light bar 10 would be increased.

The profile of the avoiding hole 54 corresponds to that of the lens 13, so that the reflective sheet 50 can shield the bottom wall 231 as much as possible. In the present embodiment, the lens 13 has a spherical crown shape, and correspondingly, the avoiding hole 54 has a circular shape. The diameter of the avoiding hole 54 ranges from 15 mm to 35 mm. Preferably, the diameter of the avoiding hole 54 is 20 mm.

If the angle between the two opposite sides of the notch 53 is too great or too small, the position relationship between the two opposite sides of the notch 53 in the installed state of the reflective sheet 50 would be affected. For example, the two opposite sides of the notch 53 may overlap with each other, or the gap between the two opposite sides of the notch 53 may be too large. In order to solve this problems, in one embodiment, in the flattened configuration of the reflective sheet 50, the angle between the two opposite sides of the notch 53 ranges from 20 degrees to 90 degrees. At the same time, the angle between the side wall 232 and the bottom wall 231 affects the angle between the two opposite sides of the notches 53. Preferably, the angle between the two opposite sides of the notches 53 is 30 degrees.

In order to facilitate the folding of the fold edge 52 relative to the central region 51, according to one embodiment of the present application, a plurality of perforations are defined along the fold line between the center region 51 and the fold edge 52, and the perforations are defined one after another along the extending direction of the fold line. The perforations are strip-shaped and extend along the corresponding side of the central region 51.

Regarding the specific form of the perforation, in one embodiment, the perforation is configured as a through-hole or a slot. When the fold edge 52 is folded with respect to the central region 51, two sides of the perforation can be attached or abutted against each other, in order to avoid influence on the reflection to the light emitting by the light bar 10.

The light bars 10 are electrically connected with each other through a flexible strip 14. The flexible strip is a conductor and has a certain flexibility convenient for coiling and thus storage, and when being used, it can be cut depending on the desired length, thereby avoiding leftover materials. In order to make the repairation to the junctions between the flexible strip 14 and the light bar 10 easier, according to one embodiment, the central region 51 of the reflective sheet 50 defines a plurality of access holes 55, and the junctions between the light bar 10 and the flexible strip 14 correspond to the respective access holes 55 one-to-one. The junctions between the light bar 10 and the flexible strip 14 can be conveniently repaired through the access holes 55.

In order to provide a certain operating space for repairing the junctions between the flexible strip 14 and the light bar 10, in one embodiment, the distance between the opposite sides of the access hole 55 along the length of the flexible strip 14 is larger than the width of the light bar 10, and the distance between the two opposite sides of the access hole 55 along the length of the light bar 10 is smaller than the width of the flexible strip 14.

In some embodiments, as shown in FIGS. 2 and 4, the light bars 10 extend longitudinally and are spaced apart from each other, with the LED beads 12 of the light bars 10 aligned with each other, and the flexible strips 14 extend transversely, with the access holes 55 aligned with each other. The LED beads 12 are arranged in a matrix on the inner side of the back plate 20, so that the light sources are evenly distributed, and at the same time, the mounting of the light bars 10 is facilitated. Here, the longitudinal and transverse directions are relative concepts, and are substantially perpendicular to each other, for example.

In order to achieve more uniform color temperature or brightness, in one preferred embodiment, the first LED beads of one light bar are aligned with the first LED beads of the adjacent light bar. In this case, the light bars 10 extend longitudinally, and all the first LED beads form a multiple-row structure, with the first LED beads in the same row extending transversely, as indicated by the indication line L1 in FIG. 3. The same applies to the second LED beads.

In another preferred embodiment, the first LED beads of one light bar are aligned with the second LED beads of the adjacent light bar. In this case, the light bars 10 extends longitudinally, and all the first LED beads also form a multi-row structure, with the first LED beads in the same row extending along the fold line, as indicated by the indication line L2 in FIG. 3. The same applies to the second LED beads.

For a single product, the above alignment configuration is selected in an alternative manner, and the configuration shown in FIG. 3 is only for the purpose of illustration and comparison.

Regarding the positional relationship between the first LED beads 15 and the second LED beads 16 of the same light bar 10, according to one embodiment of the present application, adjacent first LED beads 15 and second LED beads 16 are considered one group of beads, and the distance between the first LED bead 15 and the second LED bead 16 in the same group of beads is provided as L1, and the distance between two adjacent groups of beads is provided as L2, and L2: L1=2~8. Preferably L2: L1=6.

Specifically, L1 ranges from 5 mm to 10 mm, and L2 ranges from 20 mm to 40 mm. In the present embodiment, L1 is 5 mm and L2 is 30 mm.

The flexible strip 14 is located between two adjacent groups of beads, and at most one group of beads is arranged between two flexible strips 14. The access holes 55 are close to one side of the reflective sheet 50, and at most one group of beads is arranged between the access holes 55 and said side.

In order to enable the first LED beads 15 and the second LED beads 16 to be controlled independently, according to one embodiment, all of the first LED beads 15 are connected to a first circuit, and receive the driving signal through the first circuit, and all of the second LED beads 16 are connected to a second circuit and receive the driving signals through the second circuit.

The driving signal may originate from a control module integrated into the direct-type panel lamp. For example, in one embodiment, the direct-type panel lamp has a driving module which sends driving signals to the first circuit and the second circuit, respectively.

The driving signal may originate from a driving module independent from the direct-type panel lamp. By means of the driving signal, the LED beads can be turned on or off to achieve a desired lighting result. The driving signal may take the conventional forms.

The first circuit and the second circuit in this embodiment mainly function to enable the first LED beads 15 and the second LED beads 16 to independently receive driving signals. Therefore, the specific forms of the first circuit and the second circuit are not strictly limited. The first circuit and the second circuit may be simple electrical conductors, or circuit modules capable of transmitting driving signals, or the like, and the transmission mode thereof may be wireless or wired.

Accordingly, the number of the flexible strips 14 is two, wherein one flexible strip is connected to the driving module through the first circuit, and the other flexible strip is electrically connected to the driving module through the second circuit.

Two access holes 55 corresponding to the same light bar 10 may be defined at intervals or continuously. In the case where the two access holes 55 corresponding to the same light bar 10 are continuously defined, the two access holes 55 are communicated with the respective avoiding holes 54 located between the two access holes 55.

In the case where two access holes 55 corresponding to the same light bar 10 are continuously defined, according to one embodiment, the flexible strip 14 is located between two adjacent groups of beads, and at most one group of beads is arranged between the two flexible strips 14, in order to low the length of the access hole 55 as much as possible (the length direction of the access hole 55 corresponds to the length direction of the light bars 10). In this embodiment, one group of beads is provided between the two flexible strips 14.

Preferably, the length of the access hole 55 ranges from 80 mm to 110 mm. In this embodiment, the length of the access hole 55 is 90 mm.

Regarding the positional relationship between the first LED beads 15 and the second LED beads 16 of the same light bar 10, in other embodiments, in the same light bar 10, the distance between two adjacent first LED beads 15 is equal to that between two adjacent second LED beads 16, and the distance between the first LED bead 15 and one of the adjacent two second LED beads 16 is smaller than the distance between said first LED bead 15 and the other of said adjacent two second LED beads 16.

Specifically, in the same light bar 10, the distance between the first LED bead 15 to one of the adjacent two second LED beads 16 is provided as L3, and the distance between said first LED bead 15 and the other of said adjacent two second LED beads 16 is provided as L4, and L4: L3=1.5~6. Preferably, L4: L3=2~4. In this embodiment, L3 is 5 mm and L4 is 20 mm.

The substrate 11 may be a metal substrate, preferably an aluminum substrate, or an FR-4 glass fiber substrate. In some embodiments, the substrate 11 may be fixed to the lower surface of the back plate 20 by screws, and is preferably fixed to the lower surface of the back plate 20 by thermally conductive glue.

As in FIGS. 7-11, in some embodiments, the substrate 11 includes a metal layer 111, an insulating layer 112 and a circuit layer 113, and the LED beads 12 are soldered on the circuit layer 113. Solder pads 115 for welding the LED beads 12 are usually provided on the circuit layer 113. In order to provide protection for the circuit layer 113, the surface of the substrate 11 is coated with white solder resist ink to form a solder resist layer 144, with openings defined at the solder pads 115 to expose the solder pads 115 for welding the LED beads 12.

Lenses 13 of the light bar 10 mainly function to diffuse light. The lenses 13 are fixed on the substrate 11 by epoxy glue or UV glue. In order to facilitate installation, protruding legs 131 are provided on the back side of the lens 13, and positioning holes engaging with the protruding legs 131 are defined on the corresponding substrate 11.

In some embodiments, the flexible strip 14 is pressed on all the light bars 10 and perpendicularly intersects all the light bars 10 to facilitate the welding of the light bars 10 and the flexible strip 14. The flexible strip 14 has a strip-shaped structure and includes an insulating layer 142, a circuit layer 143 and a solder resist layer 144. The insulating layer 142 is made of insulating resin material. The solder resist layer 144 is formed by white solder resist ink coated on the surface.

In order to connect the flexible strip 14 and the substrate 11, first openings 141 are defined at the edges of the flexible strip 14 that are not coated with solder resist ink, and second openings 114 are defined at the positions of the substrate 11 close to the flexible strip 14 that are not coated with solder resist ink, with solder pads provided at the first and second openings that are electrically connected by welding.

Considering the processing and heat dissipation, the back plate 20 is stamped from a sheet metal (such as ST13) to form an arched housing-like structure, which includes a central area 221 and an edge area 22 disposed on the outer periphery of the central area 221.

Regarding the connection between the frame bars 41 and the corresponding edges of the diffusion plate 30 and the back plate 20, according to one of the embodiments, each frame bar 41 has a first mounting surface 42 and a second mounting surface 43 which are located at different levels (referring to the levels along the vertical direction in the installed state of the direct-type panel lamp 100). The edge of the diffusion plate 30 overlaps on the first mounting surface 42 at the lower level, and the edge area 22 of the back plate 20 overlaps on the second mounting surface 43 at the higher level and is fixed by fastening screws.

The edge area 22 of the back plate 20 is deformed to form ribs 24 extending along the peripheral sides of the back plate 20 to increase the strength of the edge areas 22. In some embodiments, in order to reduce the difficulty of machining the ribs 24, the edge area 22 is self-bent to form the ribs 24. The edge area 22 is bent using conventional processing methods, such as mechanical stamping or the like.

The ribs 24 press the edge of the diffusion plate 30 to abut against the first mounting surface 42. Since the back plate 20 has a certain elasticity, when the ribs 24 abut against the diffusion plate 30, the ribs 24 are elastically deformed, such that the ribs 24 exert pressure on the diffusion plate 30. The edge of the diffusion plate 30 is sandwiched between the ribs 24 and the first mount surface 42 to avoid deformation, so that the central portion of the diffusion plate (the geometric center of the diffusion plate 30 or the portion around the geometric center of the diffusion plate 30) is prevented from sagging downward.

In some embodiments, the frame bars 41 are made of metal profile (such as aluminum alloy), and the adjacent ends of the adjacent frame bars 41 are welded and fixed. Alternatively, the frame bars 41 may be formed by injection molding polymer materials. In this case, since polymer materials cannot be welded, it is generally necessary to provide corner pieces at the corners of the frame 40 to connect adjacent frame bars 41. Alternatively, adjacent frame bars 41 may be connected by overlapping and connecting with each other. However, the flatness of a frame 40 made of polymer material is poorer than that of a frame 40 made of metal profile.

Figure 6:
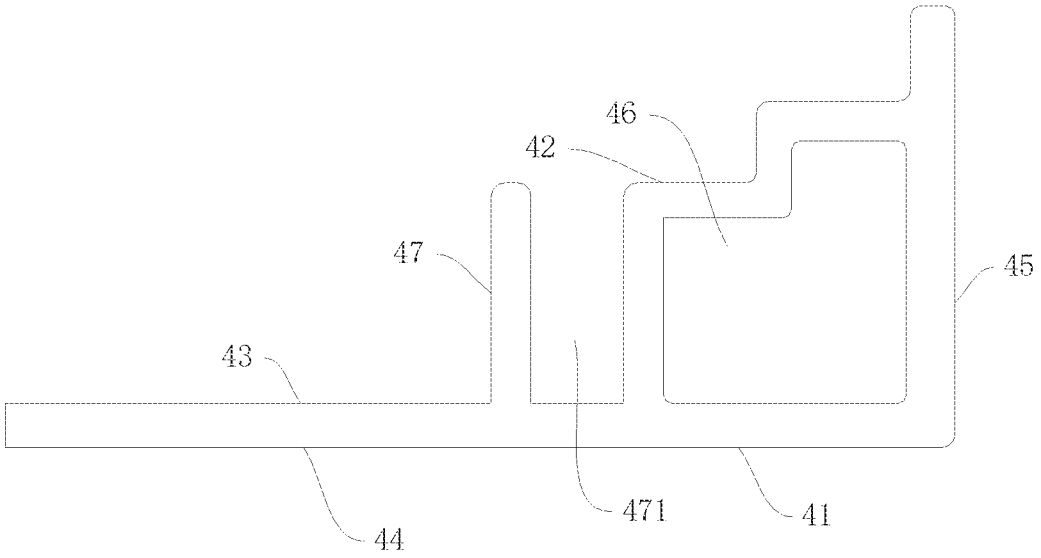
FIG. 6 is a schematic structural view of a frame bar of FIG. 1.
Figure 7:
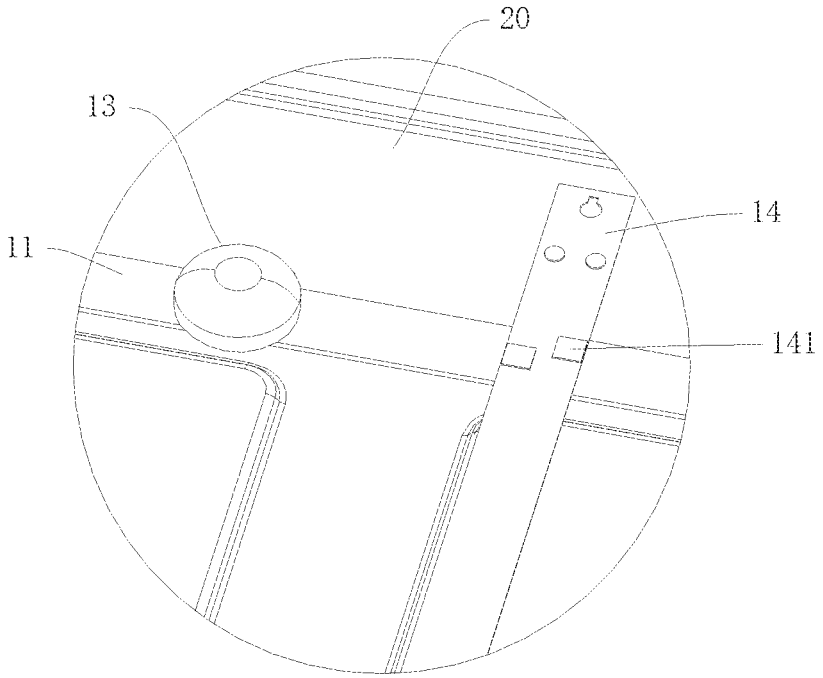
FIG. 7 is a schematic structural view showing the connection between light bars.
Figure 8:
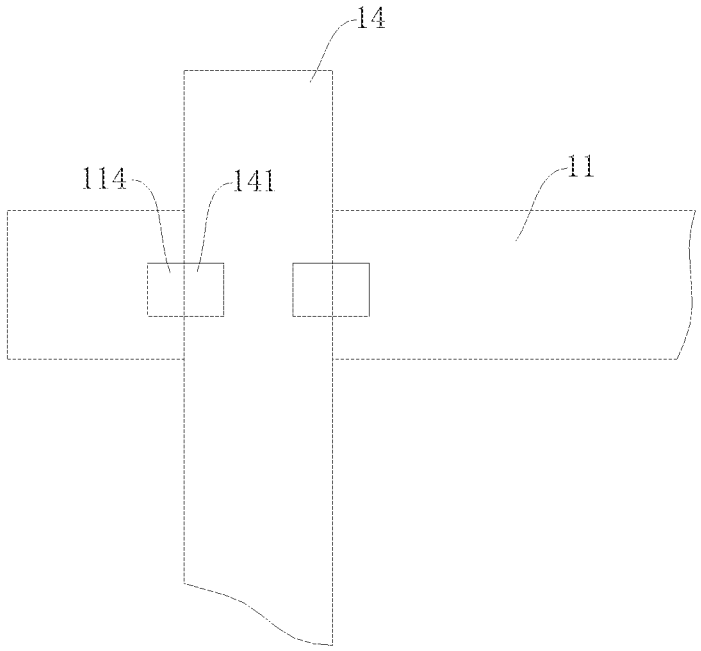
FIG. 8 is a schematic structural view showing the connection between the substrate and the flexible strip shown in FIG. 7.
Figure 9:
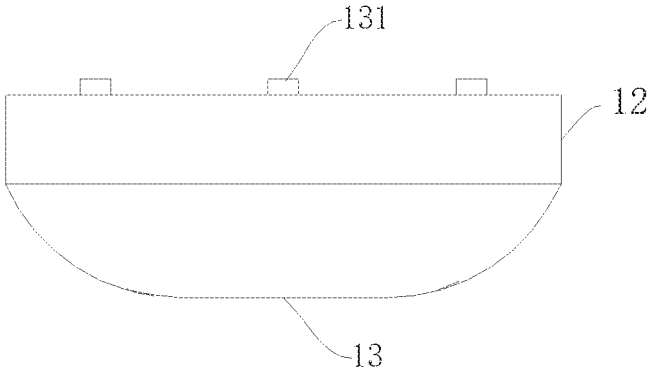
FIG. 9 is a schematic structural view of an LED bead and a lens shown in FIG. 7.
Figure 10:
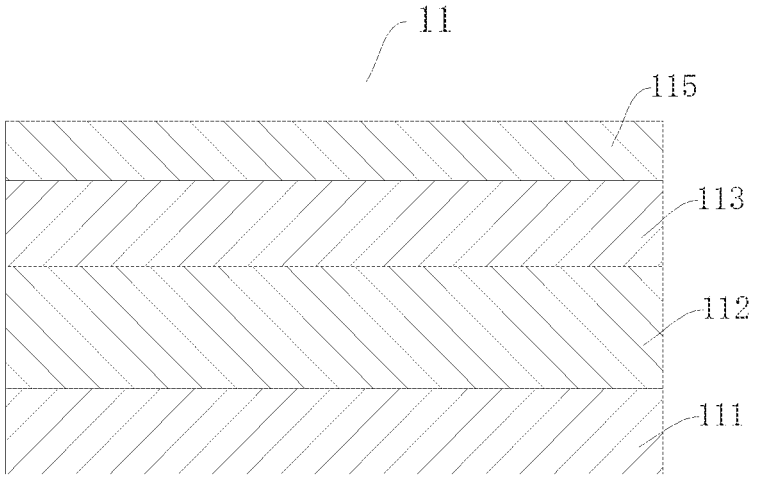
FIG. 10 is a schematic structural view of the substrate shown in FIG. 7.
Figure 11:
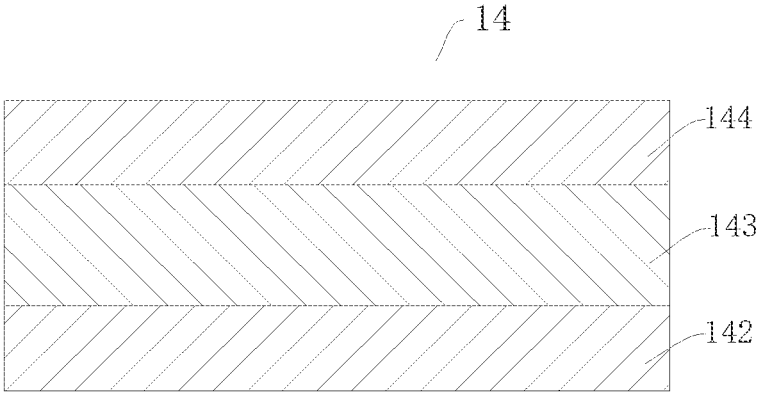
FIG. 11 is a schematic structural view of the flexible strip shown in FIG. 7.

In some embodiments, as shown in FIGS. 5 and 6, the frame bar 41 has an L-shaped cross section, and includes a horizontal portion 44 and a vertical portion 45. The edge of the diffusion plate 30 and the edge of the back plate 20 are both overlapped on the horizontal portions 44. The vertical portion 45 encloses a confined space, and functions to shield the structure of the back plate 20 at the edge and have a decorative and protective effect.

In some embodiments, in order to increase the strength of the profile, the thickness of the corner of the frame bar 41 is increased inside to form a thickened portion 46, thereby forming a stepped structure at the horizontal portion 44. The first mounting surface 42 and the second mounting surface 43 are provided on the stepped structure and the horizontal portion 44 respectively. In order to save material, in some embodiments, the thickened portion may have a hollowed structure.

Considering the processing and heat dissipation, the back plate 20 is stamped from a sheet metal (such as ST13) to form an arched housing-like structure, so that a certain distance is defined between the back plate 20 and the diffusion plate 30, and thus the light bars 10 can be accommodated. In some embodiments, the bottom wall 231 and the diffusion plate 30 are arranged in parallel. The light bars 10 are fixed on the bottom wall 231. The side wall 232 is tangentially connected with the ribs 24.

In some embodiments, the portion of the edge area 22 overlapping the frame 40 is parallel to the bottom wall 231, and the bottom wall 231 is higher than the edge area 22. In the case where the direct-type panel lamp 100 is installed on the ceiling, the bottom wall 231 is arranged horizontally, and the corresponding portion of the edge area 22 overlapping the frame 40 is also arranged horizontally.

In order to facilitate the installation of the light bar 10, in some embodiments, as shown in FIGS. 1 and 2, the bottom wall 231 is provided with grooves arranged in a crisscross pattern for receiving the light bars 10. In order to facilitate the processing of the grooves on the back plate 20, the back plate 20 is stamped to form a plurality of protrusions 211 facing away from the chamber 23, and the grooves are formed between adjacent protrusions 211. Since the light bars 10 are all arranged in parallel, the protrusions 211 should also be arranged in parallel. The gap between two adjacent protrusions 211 functions to receive the light bar 10, so the light bar 10 generally has a straight bar structure. Alternatively, the light bar may also have a coiled structure.

In some embodiments, the edge area 22 of the back plate 20 is fixed on the frame 40 by fastening screws. For ease of installation, the frame bar 41 is provided with a screw groove 471 along the length of the frame bar 41. In some embodiments, the middle portion of the upper surface of the horizontal portion 44 is provided with an upright portion 47, the gap between the upright portion 47 and the stepped structure forms the screw groove 471, and the top surface of the upright portion 47 supports the edge area 22.

In order to reduce the weight of the back plate 20 and provide the back plate 20 with sufficient supporting strength, in some embodiments, the thickness of the back plate 20 ranges from 0.2 mm to 0.4 mm. Preferably, the thickness of the back plate 20 is 0.3 mm.

Figure 12:
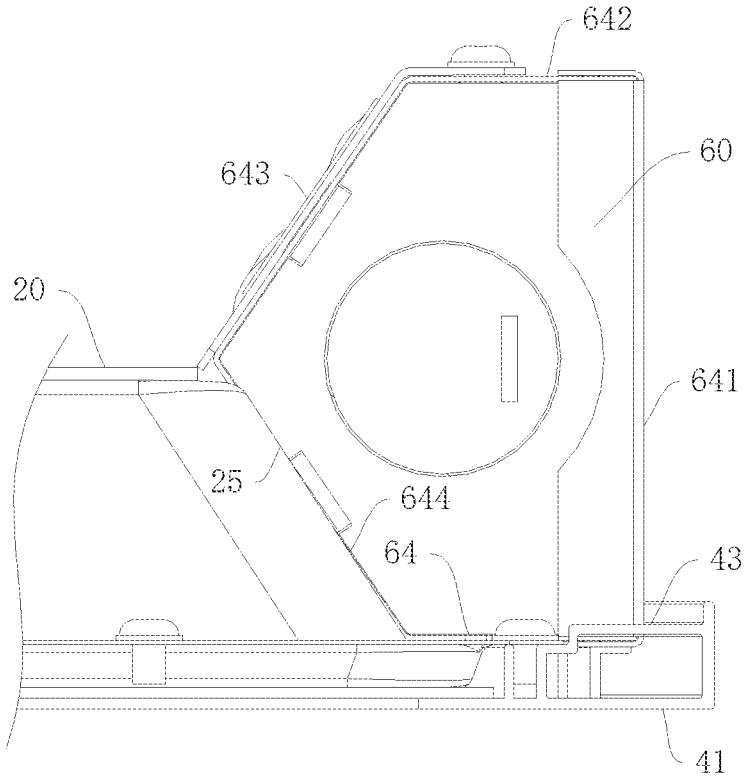
FIG. 12 is a partial schematic structural view of the direct-type panel lamp shown in FIG. 1.
Figure 15:
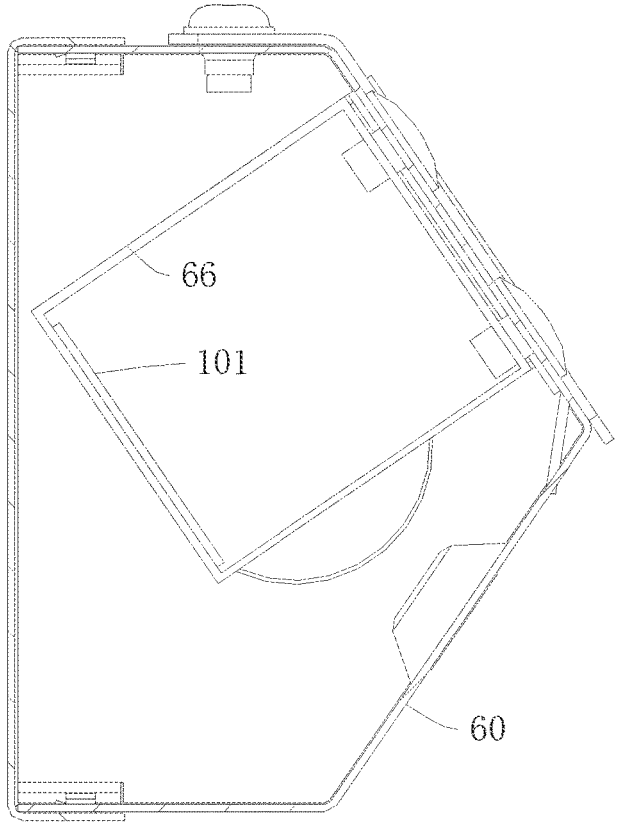
FIG. 15 is a schematic cross-sectional view of the driving box shown in FIG. 13.

To enable the direct-type panel lamp 100 to normally operate, in one embodiment, as shown in FIGS. 1 and 2, the direct-type panel lamp 100 is provided with a driving module 101, and the light bars 10 are electrically connected to the driving modules 101 via wires. In order to fix and protect of the driving module 101, the driving module is usually provided inside a driving box 60. In one embodiment, as shown in FIG. 12 and FIG. 15, the driving box 60 includes a box body 61 having an opening, and a top cover 62 snap-fit over the opening of the box body 61. The box body 61 is provided with a wire-leading hole 612 through which the connection wire of the driving module 101 passes. The box body 61 is strip-shaped as a whole and has a convex pentagonal cross section including a first side 64, a second side 641, a third side 642, a fourth side 643, and a fifth side 644 in sequence, wherein the first and third sides 64, 642 are parallel to each other, the second side 641 is perpendicular to the first side 64 and the third side 642, and wherein the box wall corresponding to the first side 64 abuts the second mounting surface 43, the box wall corresponding to the fifth side 644 abuts the back plate 20, and the box wall corresponding to the second side 641 is opened.

In the present application, the driving module 101 is received in the driving box 60 so that the driving module can be easily fixed and protected, and also the procedure for maintaining or replacing the driving module 101 can be simplified, thereby lowering time and labor costs.

To make the structure of the driving box 60 compact, in one embodiment, as shown in FIG. 12, the first side 64 is equal in length to the third side 642, and the fourth side 643 is equal in length to the second side 642. In the present embodiment, the lengths of the first side 64 and the third side 642 are both 20 mm, the length of the second side 641 is 50 mm, and the lengths of the fourth side 643 and the fifth side 644 are both 30 mm.

In order to allow the driving box 60 to be quickly positioned, in one embodiment, the outer peripheral wall of the back plate 20 is provided with a slope area 25 with which the box wall corresponding to the fifth side 644 is engagable, as shown in FIG. 12. In this case, the slope area 25 and the box wall corresponding to the fifth side 644 have the same inclination angle and are engaged with respect to each other. The inclination angle of the fifth side 644 changes with the inclination angle of the slope area 25, while the lengths of the respective sides of the convex pentagon change with the inclination angles of the fifth side 644.

In this embodiment, the angle between the slope area 25 and the vertical axis ranges from 10 degrees to 20 degrees. Preferably, the angle between the slope area 25 and the vertical axis is 16 degrees.

In order to facilitate the packaging of two direct-type panel lamps 100, the two direct-type panel lamps are placed in such a manner that the back plates 20 of the two direct-type panel lamps face each other. In this case, as the driving box 60 is located on the outer periphery of the back plate 20, and the top surface of the driving box 60 is higher than the back plate 20, the box wall corresponding to the fourth side 643 of driving box 60 of each direct-type panel lamp 100 abuts the slope area 25 of the opposite direct-type panel lamp 100. For the same direct-type panel lamps 100, the height of the slope area 25 is high than that of the back plate 20, so that when two direct-type panel lamps 100 are packaged together, the top surface of the driving box 60 of one of the two direct-type panel lamps 100 can abut against the frame 40 of the other, with a gap maintained between the two back plates 20 to avoid deformation of the back plates 20.

Regarding the installation position of the driving box 60, according to one embodiment, an installation region (not shown in the figures) is formed between the vertical portion 45 and the outer periphery of the back plate 20, and the driving box 60 is disposed in the installation region.

Figure 13:
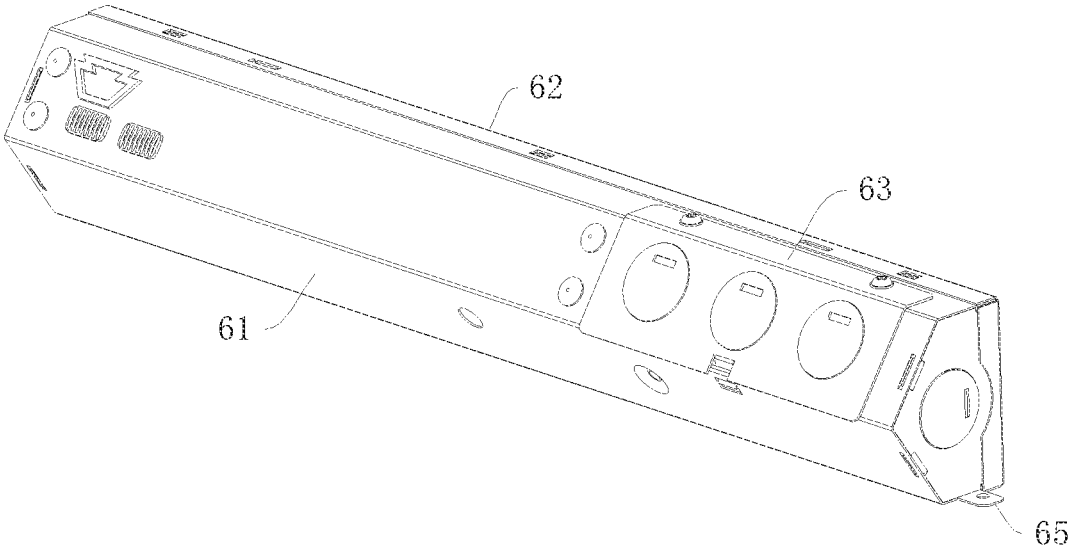
FIG. 13 is a schematic structural view of a driving box shown in FIG. 12.

Regarding the installation form of the driving box 60, according to one of the embodiments, as shown in FIG. 13, two ends of the driving box 60 are provided with tabs 65 with screw holes. The tab 65 is fixed to the frame 40 (in particular, the screw groove 471) by means of fastening screws. The tab 65 is connected to the box wall corresponding to the first side 64, and the bottom surface of the tab 65 is flush with that of the box body 61. In order to reduce the difficulty of processing the junctions between the tabs 65 and the box body 61 and to enhance the structural strength of the junctions between the tabs 65 and the box body 61, the tabs 65 and the box body 61 are formed in one piece.

Figure 14:
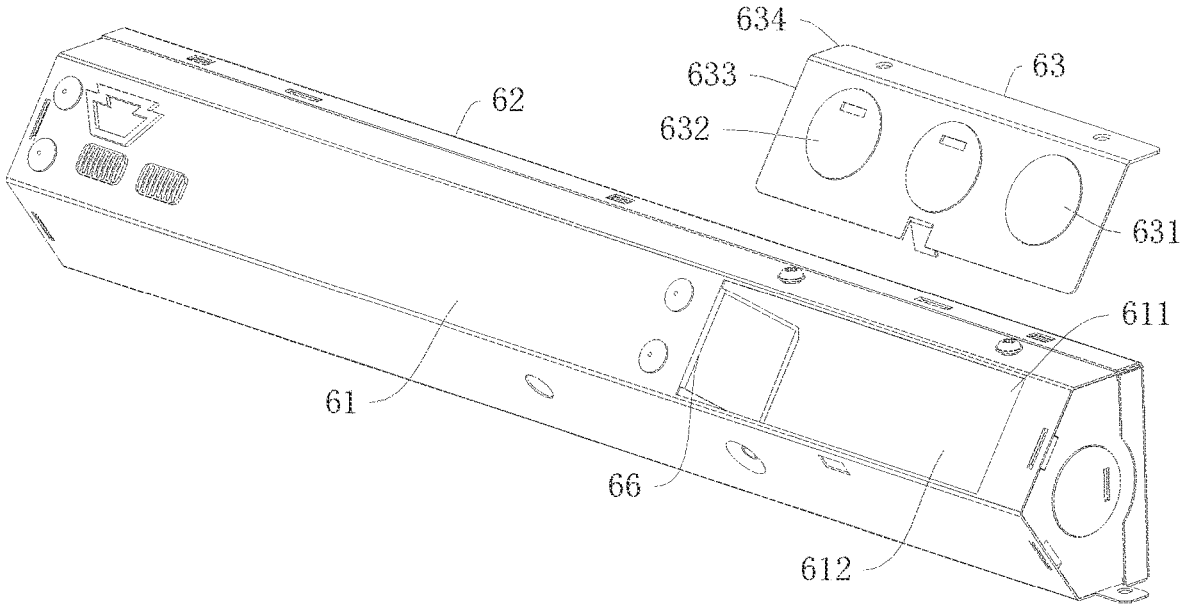
FIG. 14 is an exploded schematic structural view of the driving box shown in FIG. 13.

In order to allow the wire-leading hole 612 to avoid the back plate 20 and facilitate the operation of the connection wires, according to one embodiment of the present application, as shown in FIGS. 13 and 14, the wire-leading hole 612 is defined on the box wall corresponding to the fourth side 643. The driving box 60 further includes a cover plate 63 installed on the box body 61 and engaged with the wire-leading hole 612. The cover plate 63 defines a plurality of single holes 631 corresponding to the wire-leading holes 612. The number of the single holes 631 may be determined depending on the number of connection wires, and the connection wires pass out of the respective single holes 631 to quickly divide the connection wires.

The cover plate 63 is bent to form a cover portion 633 and a fixed portion 634, wherein the cover portion 633 is fixed to the box wall corresponding to the third side 642, and the cover portions 633 are attached to the box wall according to the fourth side 643. The single holes 631 are defined in the cover portion 633.

In order to prevent foreign matter from entering into the driving box 60 to affect the driving module 101 when the driving box 60 is not in use, according to one embodiment, as shown in FIGS. 13 and 14, a plurality of single covers 632 are further arranged on the cover plate 63. The plurality of single covers 632 are respectively disposed in one-to-one correspondence with the single holes 631. Further, the single cover plate 632 is connected to the inner edge of the single hole 631 through a deformable connecting member (not shown in the figures) so that the cover plate 632 can be opened by snapping the cover plate 632.

The driving box 60 is formed by a metal plate to reinforce the structural strength of the driving box 60. In order to reduce the influence of the driving box 60 on the driving module 101, according to one embodiment, the direct-type panel lamp 100 further includes an insulating box 66 installed in the driving box 60, and the driving module 101 is installed inside the insulating box 66.

The insulating box 66 has a strip shape and is arranged in the driving box 60 with at least one end opened. The open end is used for the connection wires of the driving module 101 passing through. In this embodiment, both ends of the insulating box 66 are opened.

In some embodiments, the insulating box 66 has a rectangular cross-section that is circumferentially closed. One of two opposite side walls of the insulating box 66 is attached to and secured with one side wall of the box body 61, the other is fixed with the driving module 101. In the case where the insulating box 66 is fixed on the side wall of the box body 61 by bolts or rivets, the driving modules 101 may avoid the bolts or the rivets, in order to reduce the influence of the bolts or the rivets on the driving module 101.

Regarding the installation position of the insulating box 66, according to one of the embodiments, the longitudinal direction of the driving box 60 coincides with that of the insulating box 66. One end of the insulating box 66 is adjacent to one end of the driving box 60, and a wire leading cavity 611 is formed between the other end of the insulating box 66 and the other end of the driving box 60. The wire leading hole 612 communicates with the wire leading cavity 611. The wire leading hole 612 and the insulating box 66 are located on the same side wall of the box body 61, and the wire leading hole 612 and the insulating box 66 are arranged in sequence along the length direction of the driving box 60.

In order to provide the wire leading cavity 611 with a certain operating space, in some embodiments, the length of the driving box 60 is provided as D1, and the length of the insulating box 66 is provided as D2, and D1 and D2 satisfy D1: D2=1.5~3. Preferably, D1: D2=2.

In order to allow the connection wire of the driving module 101 to pass through the gap between the driving box 60 and the insulating box 66 when passing from the end of the insulating box 66 away from the wire leading cavity 611 to the wire leading hole 612, in some embodiments, the cross-sectional area of the driving box 60 is provided as S1, and the cross section of the insulating box 66 is provided as S2, and S1 and S2 satisfy S1: S2=1.2~2. Preferably, S1: S2=1.5.

The technical features of the above embodiments can be combined arbitrarily. To make the description concise, all possible combinations of the technical features in the above embodiments are not described. However, as long as there is no contradiction in the combination of these technical features, it should be regarded as within the scope of this specification. When the technical features of different embodiments are reflected in the same drawing, it can be regarded that the drawing also discloses the combination examples of the various embodiments involved.

The above examples only express several implementations of the application, and the descriptions are more specific and detailed, but they should not be interpreted as a limitation on the scope of the patent application. It should be pointed out that for those of ordinary skill in the art, without departing from the concept of this application, several modifications and improvements can be made, and these all fall within the protection scope of this application.

What is claimed is:

1. A direct-type panel lamp with adjustable light emitting function, comprising:

more than one light bars, each light bar comprising a substrate, and LED beads fixed on the substrate;

a back plate and a diffusion plate arranged opposite to each other and together form a chamber, and the light bars are arranged in the chamber and fixed to the back plate, wherein a central area of the back plate is arched to form the chamber with a desired space, and the chamber comprises a flat bottom wall to which the light bars are fixed, and a side wall at a periphery of the bottom wall; and a reflective sheet, and the reflective sheet comprises a central region and a fold edge extending along a peripheral side of the central region, and wherein the fold edge defines notches at corners thereof, the central region of the reflective sheet is in contact with the bottom wall, the fold edge is in contact with the side wall, and two opposite sides of the notch are engaged with each other to form a box-like structure: wherein the reflective sheet is further provided with a plurality of access holes; and adjacent light bars are electrically connected by a flexible strip, and junctions of the light bars and the flexible strip correspond to the respective access holes one by one.

2. The direct-type panel lamp with adjustable light emitting function according to claim 1, wherein the light bars extend longitudinally and are spaced apart from each other, and the flexible strip extends transversely.

3. The direct-type panel lamp with adjustable light emitting function according to claim 1, wherein for the same light bar, the LED beads comprise a plurality of first LED beads and a plurality of second LED beads, and wherein the first LED beads and the second LED beads are alternately arranged, and the brightness or color temperature of the first and second LED beads are different.

4. The direct-type panel lamp with adjustable light emitting function according to claim 3, wherein the first LED beads of one of two adjacent light bars are aligned with the first LED beads of the other of two adjacent light bars one by one.

5. The direct-type panel lamp with adjustable light emitting function according to claim 3, wherein in the same light bar, a first LED bead and an adjacent second LED bead are defined as one group of beads, two flexible strips are provided, and the flexible strip is located between two adjacent groups of beads, and at most one group of beads is arranged between two flexible strips.

6. The direct-type panel lamp with adjustable light emitting function according to claim 3, wherein, in the same light bar, an interval between two adjacent first LED beads is equal to an interval between two adjacent second LED beads; and for any first LED bead and two second LED beads adjacent to the first LED bead, a distance from the first LED bead to one of the two second LED beads is smaller than a distance from the first LED bead to the other of the two second LED beads.

7. The direct-type panel lamp with adjustable light emitting function according to claim 1, wherein the diffusion plate is made of a light-transmitting material and closes the chamber with the back plate.

8. The direct-type panel lamp with adjustable light emitting function according to claim 1, wherein a frame is arranged around the back plate and the diffusion plate, and the frame is formed by connecting a plurality of frame bars, each frame bar is connected with corresponding edges of the diffusion plate and the back plate.

9. The direct-type panel lamp with adjustable light emitting function according to claim 1, wherein the LED beads are respectively covered with lenses.

10. The direct-type panel lamp with adjustable light emitting function according to claim 9, wherein each substrate of the more than one light bars is located between the reflective sheet and the back plate, and the reflective sheet is provided with avoiding holes for avoiding the LED beads and the lenses.

* * * * *